United States Patent [19]

Reese

[11] 3,998,042

[45] Dec. 21, 1976

[54] MIXED SHRINKAGE YARN

[75] Inventor: Cecil E. Reese, Kinston, N.C.

[73] Assignee: E. I. Du Pont de Nemours and Company, Wilmington, Del.

[22] Filed: Dec. 15, 1975

[21] Appl. No.: 640,775

Related U.S. Application Data

[63] Continuation-in-part of Ser. No. 551,963, Feb. 21, 1975, abandoned, Continuation-in-part of Ser. No. 439,643, Feb. 4, 1974, abandoned, Continuation-in-part of Ser. No. 292,300, Sept. 26, 1972, Pat. No. 3,927,167.

[52] U.S. Cl. ..... 57/140 BY; 57/157 R; 260/75 R; 264/210 F; 428/369

[51] Int. Cl.[2] ..... D02G 3/24; D02G 1/18; D02G 3/02

[58] Field of Search ..... 57/140 BY, 140 R, 157 R, 57/157 F; 28/72.17; 264/103, 210 F, 290 T; 260/75 R, 75 N, 75 S; 428/369, 370, 371

[56] References Cited

UNITED STATES PATENTS

| | | | |
|---|---|---|---|
| 3,199,281 | 8/1965 | Maerov et al. | 57/140 BY |
| 3,200,576 | 8/1965 | Maerov et al. | 57/140 BY |
| 3,416,302 | 12/1968 | Knospe | 57/140 BY |
| 3,593,513 | 7/1971 | Reese | 57/140 BY |
| 3,608,296 | 9/1971 | Taylor | 57/140 BY |
| 3,626,442 | 12/1971 | Haseley et al. | 57/140 BY |
| 3,705,225 | 12/1972 | Taylor | 264/210 F |

*Primary Examiner*—John Petrakes

[57] ABSTRACT

Mixed-shrinkage, continuous-filament, heat-bulkable yarn, composed of low and higher shrinking filaments of different polyester compositions, develops worsted-like bulk in fabric as a result of fabric finishing operations. The yarn is prepared from two ethylene terephthalate polyesters, of different compositions and relative viscosities, by cospinning, drawing and heat-setting the filaments under identical, critically-controlled conditions.

6 Claims, 1 Drawing Figure

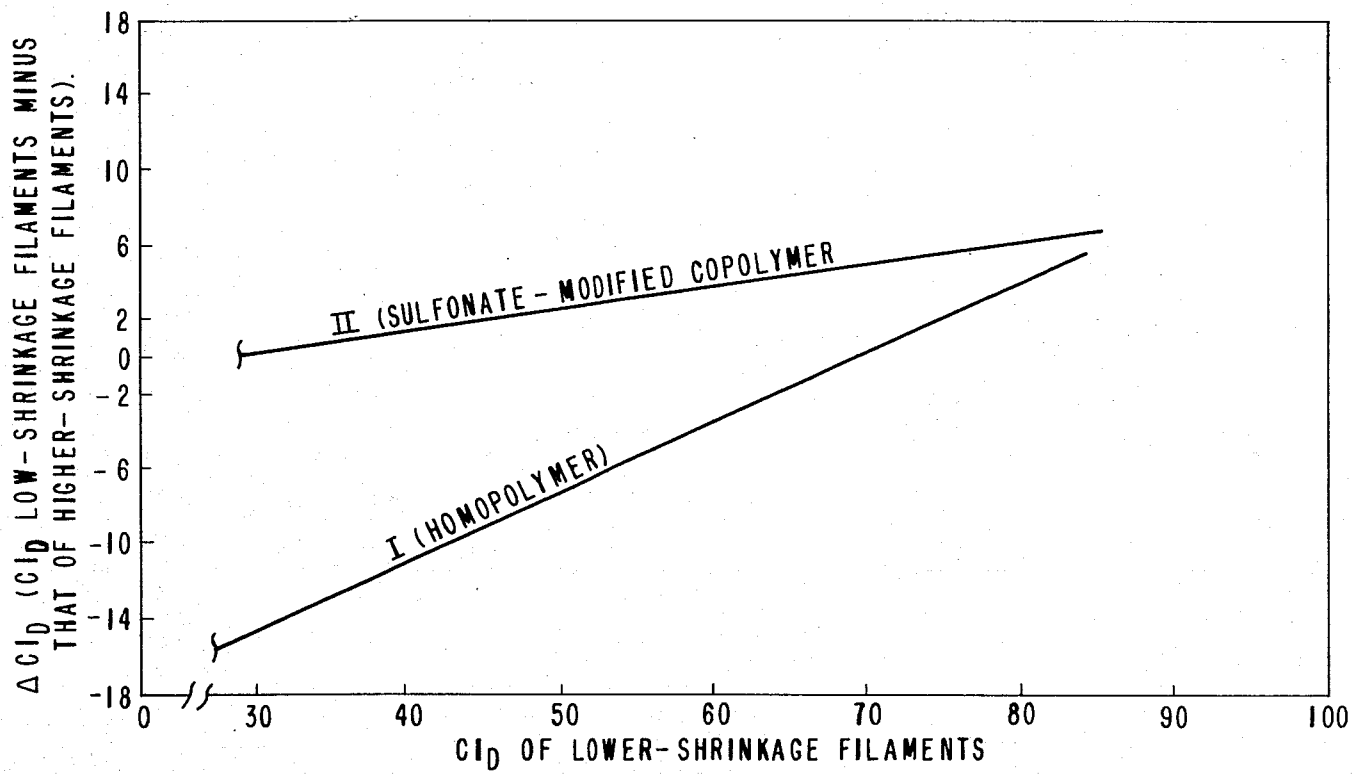
II (SULFONATE-MODIFIED COPOLYMER
I (HOMOPOLYMER)
$CI_D$ OF LOWER-SHRINKAGE FILAMENTS
$\Delta CI_D$ ($CI_D$ LOW-SHRINKAGE FILAMENTS MINUS THAT OF HIGHER-SHRINKAGE FILAMENTS).
0
30
40
50
60
70
80
90
100
18
14
10
6
2
0
-2
-6
-10
-14
-18

MIXED SHRINKAGE YARN

REFERENCE TO RELATED APPLICATIONS

This is a continuation-in-part of my copending application Ser. No. 551,963, filed Feb. 21, 1975, now abandoned, as a continuation-in-part of application Ser. No. 439,643, filed Feb. 4, 1974, now abandoned, as a continuation-in-part of application Ser. No. 292,300 filed Sept. 26, 1972 now U.S. Pat. No. 3,927,167.

BACKGROUND OF THE INVENTION

This invention relates to bulkable polyester textile yarns, and more particularly to mixed-shrinkage yarn composed of an intimate mixture of polyester filaments of different chemical composition.

Mixed-shrinkage yarns are composed of low-shrinkage filaments and higher-shrinkage filaments. They can comprise polyethylene terephthalate filaments which have been produced under different conditions and then combined by twist-plying or jet-interlacing as disclosed in Maerov et al. U.S. Pat. No. 3,199,281. When the filaments are heat-shrunk, the higher-shrinking filaments pull the other filaments into a bulky configuration. A mixed-shrinkage yarn has been obtained by simultaneously melt-spinning polyethylene terephthalate filaments, one yarn bundle of low relative viscosity and the other of higher relative viscosity, quenching them differently, combining the two bundles of filaments into a composite yarn, and then drawing and heat-setting the filaments under the same conditions, as disclosed in my U.S. Pat. No. 3,444,681. A mixed-shrinkage yarn is obtained because the two types of filaments respond differently to the drawing and heat-setting treatments.

SUMMARY OF THE INVENTION

New aesthetically pleasing bulky fabrics have now been produced when a mixed-shrinkage yarn has a degree of filament intermingling (DFI) of between 65 and 100 percent (preferably 80 to 100%) and the differential filament length (DFL) of the filaments, after heating to develop bulk, is at least 3.5 percent. Determination of DFL is defined subsequently, and DFI is determined as described in column 2 of my U.S. Pat. No. 3,593,513. It is desirable to produce yarn meeting these requirements from the known fiber-forming ethylene terephthalate copolymers. Mixed-shrinkage yarns of filaments having different chemical compositions are frequently desirable for improving the affinity for dyes and imparting heather effects.

The present invention provides mixed-shrinkage yarn composed of low-shrinkage polyethylene terephthalate filaments, which may be modified with up to 3 mole percent of basic-dye-sensitizing polymer structural units, and higher-shrinkage copolyester filaments wherein 85 to 95 mole percent of the polymer structural units are ethylene terephthalate and the remaining 15 to 5 mole percent are ester units that retard crystallization relative to the low-shrinkage filaments. The mixed-shrinkage yarn imparts highly desirable aesthetics, bulk and hand to fabrics produced therefrom. The yarn is substantially free from undesirable loops after take-off from yarn packages. The yarn can be woven or knitted before bulk is developed and the bulk developed subsequently by normal finishing treatments of the fabric so the yarn is easy to process. A high degree of filament intermingling provides freedom from moire in fabric.

The mixed-shrinkage yarn of the present invention is composed of 25 to 75 percent low-shrinkage polyester filaments and 75 to 25 percent higher-shrinkage polyester filaments having a degree of filament intermingling between 65 and 100 percent (preferably about 80 to 100 percent). The filaments are free from undrawn segments and have break elongations within a range of 15 percentage units, i.e., there is no more than 15 percentage units difference between higher and lower percent elongations at break. Preferably, the break elongations are between 18 percent and 40 percent. Preferably, the denier per filament is substantially uniform and between 1 and 5.

The low-shrinkage filaments consist of a polyester of about 97–100 mole percent ethylene terephthalate structural units and about 3–0 mole percent of polymer structural units which contain sulfonate groups as pendant parts of repeating units in the polymer chain. These filaments have a crystallinity index ($CI_L$) of about 35 to about 80 percent and a relative viscosity of about 14 to 19.

The higher-shrinkage filaments are copolyesters of ethylene terephthalate with other ester units to retard crystallization relative to the homopolymer. These copolyesters contain 85–95 mole percent of ethylene terephthalate structural units and have a relative viscosity of about 28 to 40. The difference ($\Delta CI$) obtained by subtracting the crystallinity index ($CI_H$) of the higher-shrinkage filaments from $CI_L$ of the lower-shrinkage filaments should be equal to or greater than the $\Delta CI$ obtained from the formula $(0.39–0.13M)CI_L–26.1 + 11.3M$ wherein M is the mole percent of sulfonate-containing units in the polyester of the low-shrinkage filaments and $CI_L$ is the crystallinity index of the low-shrinkage components. Negative values for $\Delta CI$ are included, e.g., a value of −7 is greater than a value of −11 obtained from the formula, and a yarn of filaments having these values would meet the crystallinity index requirement.

The 15 to 5 mole percent of other ester units used in the copolyester will usually be structural units represented by the formula

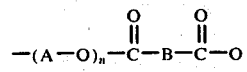

wherein A is a lower alkylene group containing at least 2 carbon atoms; $n$ is 1, 2 or 3; and B is a divalent hydrocarbon group having up to 10 carbon atoms in the polyester chain and is free from aliphatic unsaturation.

Mixed shrinkage yarns of this invention also include products characterized as in my U.S. Pat. No. 3,927,167, which claims a process for producing them. The low-shrinkage filaments consist of polyester having a relative viscosity of 14 to 19, a density of at least 1.3800, and wherein 95 to 100 mole percent of the polymer structural units are ethylene terephthalate and the remaining 5 to 0 mole percent of structural units are ethylene 5-(alkali metal sulfo)isophthalate. The higher shrinkage filaments consist of a different polyester having a relative viscosity greater than 27, a density of less than 1.3840, a boil-off shrinkage greater than 7.5 percent, a break elongation within 15 percentage units of the low-shrinkage filaments, and wherein 85 to 95 mole percent of the structural units are ethylene terephthalate and the remainder are crystallization retardant units forming a copolyester therewith.

BRIEF DESCRIPTION OF THE DRAWING

The drawing in a graph showing the relationship between the crystallinity index ($CI_L$) of the low-shrinkage filaments and differences in crystallinity index ($\Delta CI$) between low- and higher-shrinkage filaments required to obtain a differential filament length (DFL) of 3.5 percent

DETAILED DESCRIPTION OF THE INVENTION

In a preferred process for preparing mixed-shrinkage yarns of the present invention, low-shrinkage filaments and higher-shrinkage filaments of different chemical composition are prepared simultaneously under identical conditions by cospinning the different polyester compositions from separate orifices of the same spinneret, quenching the filaments and combining them into a yarn, applying a typical spin finish, drawing the yarn to at least the natural draw ratio of the filaments, annealing the yarn at constant length, applying a second finish and packaging the yarn. The yarn so produced has lower-shrinkage filaments with dry-heat shrinkage (DHS) of less than about 10 percent and higher-shrinkage copolyester filaments with a carrier shrinkage (CS) of at most about 20% (preferably 15% or lower), a relative viscosity (RV) between about 28 and about 40, and a break elongation of within 15 percentage units of the lower-shrinkage filaments. The difference in CI between the lower-shrinkage filaments and the higher-shrinkage filaments is at least $$(0.39-0.13M)CI_L-26.1 + 11.3M$$

wherein M is the mole percent of sulfonate-containing units in the copolyester of the lower-shrinkage filaments and $CI_L$ is the crystallinity index of the lower-shrinking filaments.

The yarn can be drawn while passing through a steam jet using superheated steam at 200° to 270° C and 40 to 95 pounds per square inch gauge pressure or in an 85° to 100° C water bath. Steam-drawn yarn can be annealed at a temperature as low as 110° C to provide the indicated properties.

It is preferred that the filaments of a yarn be drawn to at least the natural draw ratio, since less complete drawing results in undrawn segments which cause uneven dyeing and harsh hand in fabric. For uniform drawing of a composite yarn, the filaments have approximately the same natural draw ratio and also draw to nearly the same break elongation. Compatible break elongations are those having no greater than about 15 percentage units difference. This range limitation is necessary in order to avoid broken filaments and segments which are weak or cause unevenly dyed filaments. This is accomplished by proper selection of polymer and control of the spinning and annealing conditions.

If the break elongations of the filaments vary outside this range, degree of filament intermingling (abbreviated "DFI" herein, and explained in Reese U.S. Pat. No. 3,593,513) will be too low and fabrics produced from the yarn will contain defects such as "fisheyes"; i.e., tiny loops. Furthermore, remembering that each filament must be drawn at the same draw ratio, if the draw is selected to accommodate the lower-elongation filaments, the higher-elongation filaments will be underdrawn causing undrawn segments which result in dye nonuniformities or weak spots; conversely, if the draw ratio is selected to fit the higher-elongation filaments, the lower-elongation filaments will break upon drawing. Break elongation for either component of the new yarn preferably should be between about 18 percent and 40 percent.

Whenever used in this specification, including the claims, the following expressions have the meaning given below.

Crystallinity Index (CI) relates to the degree of crystallinity of a polymer. Because the density of a polymer is related to its crystallinity and density measurements are easier to perform, density is preferably used to determine CI. The relationship has been described by Starkweather and Moynihan in J. Polymer Sci. 22, 363 (1956). The method for measuring density described in "Physical Methods of Investigating Textiles", R, Meridith and J. W. S. Hearle, Textile Book Publishers, Inc., 1959, at pages 174–176 may be used. Carbon tetrachloride and n-heptane are suitable liquids for use with polyethylene terephthalate. CI is measured as follows: the amorphous density ($\rho a$) of the polymer is determined by first making a film of the polymer. The film is made by pressing a mass of the polymer between two platens of a press using a pressure of about 6000 psig. The temperature of the polymer should be from 20° to 40° C. above its melting temperature. Polymer melting temperature can be determined by standard Differential Thermal Analysis, but another suitable method may be chosen. The pressed film is allowed to remain at the stated temperature and pressure for 30 seconds and then it is quickly immersed in a water-ice bath. Density is measured on parts of three samples so prepared and the values are averaged ($\rho a$). Other parts of the three samples are annealed at 200° C. for 18 to 20 hours, and their average density ($\rho c$) is determined. Temperatures above 200° C. are sometimes found to cause polymer degradation and annealing periods longer than 20 hours cause essentially no increase in $\rho c$. Crystallinity index (CI) for a sample may then be calculated as follows:

$$CI(\%) = \frac{\rho x - \rho a}{\rho c - \rho a} \times 100 .$$

wherein $\rho x$ is the density of the sample to be measured. When CI is mentioned herein, the value in percent as shown in the above formula is meant unless stated otherwise.

For any given polymer composition the values of $\rho a$ and $\rho c$ are constant; for example, for polyethylene terephthalate homopolymer, $\rho a = 1.3400$ gm/cc and $\rho c = 1.4159$ gm/cc.

Relative Viscosity (RV) is a measure of molecular weight. It is the ratio of the viscosity of a solution of 2.15 gm of polymer dissolved at 140° C in 20 ml of fomal to the viscosity of the fomal itself, both measured at 25° C in a capillary viscometer and expressed in the same units. Fomal is a mixture of 10 parts by weight of phenol and 7 parts by weight of 2,4,6-trichlorophenol. The relative viscosities are measured on filaments after spinning, drawing and annealing unless otherwise specified. The polymer before spinning usually has a slightly higher relative viscosity to compensate for degradation which takes place during the melt-spinning operation.

Break Elongation is measured according to the ASTM designation D-2256–69 (incorporating editorial edition of Section 2 and renumbering of subsequent sections as done in March, 1971). It is defined as in Option 3.3 "Elongation at Break" of Section 3. The testing is performed on straight multifilament yarns which were conditioned by storing them at 65 percent relative humidity and 70° F (21.1° C) for 24 hours prior to testing. An Instron Tensile Testing Machine is used. The test sample is 5 inches (12.7 cm) long, no twist is added, the cross-head speed is 10 inches per minute (25.4 cm/min), the rate of attenuation is 200 percent per minute, and the chart speed is 5 inches per minute (12.7 cm/-min).

Shrinkage in Carrier (abbreviated "CS") and Dry Heat Shrinkage (abbreviated "DHS") describe shrinkage of higher-shrinkage filaments and lower-shrinkage filaments respectively. The degree of shrinkage under specified conditions permits a determination of compatability of various filaments and their effectiveness in mixed-shrinkage yarns. The yarn to be tested is wound on a reel the number of times required to achieve a denier of 3,000 using the formula:

$$n = 1500/D$$

wherein $n$ is the number of turns and D is the denier of the yarn. Obviously, the loop denier increases 2D for each $n$. The loop is removed from the reel and a 150 gm weight is suspended from it and its length is measured ($L_1$). The weight is then removed, and the loop is transferred to a boiling two-liter aqueous bath which contains 5 grams per liter of carrier. The carrier used is "Cindye DAC-472". a self-emulsifiable blend of alkyl and aryl esters (containing butyl benzoate) sold commercially as a carrier for dyeing polyester fibers, by Cindet Chemicals Incorporated, Greensboro, North Carolina, U.S.A. Similar results are obtained by using a carrier comprising a mixture of about 0.2 percent sodium lauryl sulfate, about 20 percent sodium sulfate, about 40 percent benzanilide, and about 40 percent dimethyl terephthalate. After thirty minutes, the loop is removed from the bath, air-dried and tensioned slightly, just enough to straighten the shortest constituent loops by suspending a 75 gram weight from the skein and the length of the skein is measured ($L_2$). CS is then calculated by the formula:

$$CS(\%) = \frac{L_1 - L_2}{L_1} \times 100 .$$

The skein is then placed on a rigid, adjustable frame which is adjusted to just straighten the shortest loops; and the frame, bearing the skein, is then placed in an oven set at 160° C dry heat. After 30 seconds' exposure, the frame is removed from the oven and is cooled, and the loop is removed from the frame. A twenty-gram weight is suspended from the skein and the load is increased manually until the short loops are as long as the long loops and, while the skein is in this condition, its length is measured ($L_3$). DHS is then calculated by the following formula:

$$DHS(\%) = \frac{L_1 - L_3}{L_1} \times 100$$

Differential Filament Length (DFL) is an expression of the length change in the filaments of a yarn upon specific heat treatments. DFL has been found to be related to the amount of bulk in the final fabric. DFL is derived from the lengths obtained in the CS and DHS methods as follows:

$$DFL(\%) = \frac{L_3 - L_2}{L_2} \times 100$$

Since $L_3 = L_1 - \frac{DHS\,(L_1)}{100}$, and $L_2 = L_1 - \frac{CS\,(L_1)}{100}$, $$DFL(\%) = \frac{\left[L_1 - \frac{DHS\,(L_1)}{100}\right] - \left[L_1 - \frac{CS\,(L_1)}{100}\right]}{L_1 - \frac{CS\,(L_1)}{100}} \times 100 =$$

$$\frac{(100 - DHS) - (100 - CS)}{(100 - CS)} \times 100 =$$

$$\frac{CS - DHS}{100 - CS} \times 100$$

Annealing is preferably carried out at constant length by passing the yarn over draw rolls which are heated to a temperature within the range of about 110° to 175° and usually about 140° C. The upper temperature for annealing is limited by the sticking temperature of the higher-shrinkage component and the lower temperature for annealing is limited by the CS of the higher-shrinkage component which should not exceed 20%. Yarn exposure to the heated rolls should be from about 1 second to 0.001 second.

The lower-shrinkage filaments are prepared from polyester wherein 97 to 100 mole percent of the structural units are ethylene terephthalate and about 3 to 0 mole percent are organic groups which contain sulfonate groups as pendant parts of repeating units in the polymer chain to impart sensitivity to basic dyes.

The lower-shrinkage polyethylene terephthalate (2G-T) filaments may be prepared by any of a variety of procedures known in the art, such as by one of the methods taught by Whinfield and Dickson in U.S. Pat. No. 2,465,319. Preferably, when the RV of the 2G-T filaments is on the low side, e.g., 14.5, a suitable melt-viscosity booster is used such as described in Meade et al. U.S. Pat. No. 3,335,211, to facilitate spinning. Sulfonate-containing copolymers usually do not need such boosters. A preferred copolyester has 98 mole percent ethylene terephthalate and 2 mole percent ethylene 5-(sodium sulfo)isophthalate, abbreviated 2G-T/IS (98/2). Preferably, the lower-shrinkage filaments have an RV of between 14 and 19. This is substantially less than the normal RV (about 26) of commercial polyethylene terephthalate yarns. RV's of lower than about 20 have been avoided for continuous filament yarns in the past and low-RV yarns have not become successful commercial products because they have inadequate properties.

Methods of producing such basic-dye-sensitive terephthalate copolyesters are shown in Griffing et al. U.S. Pat. No. 3,018,272. Many such polymers are shown in the Griffing et al. patent.

Illustrative of the organic sulfonate-containing groups which may be included in the polymer chain are those which correspond to any of the following structural formulas:

Formula a)

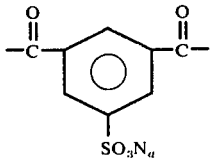

Formula b)

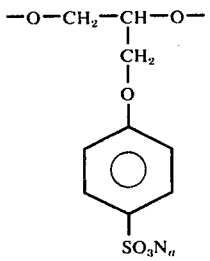

Formula c)

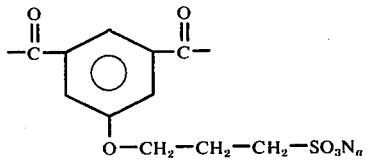

Formula d)

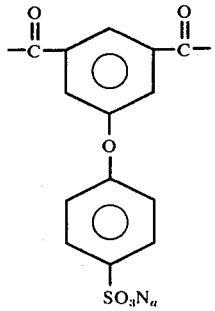

The higher-shrinkage filaments are prepared from a polyester different from the polyester used for the lower-shrinkage filaments wherein 85 to 95 mole percent of the structural units are ethylene terephthalate and the remainder are other ester units to retard crystallization of the copolyester relative to the lower-shrinkage component. Any of the structural units known to form useful copolyester filaments with ethylene terephthalate may be used for the purpose. This use of a crystallization retardant in proper amount makes possible cospinning and processing the lower-and higher-shrinkage filaments under identical conditions to provide mixed-shrinkage yarn having the desirable properties indicated herein. The higher-shrinkage filaments have an RV of about 28 to 40.

A large number of ethylene terephthalate copolyesters are known to provide useful filaments and can be used for the present purpose. The glycol and/or the acid can be varied, or caprolactone can also be used to provide

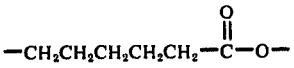

structural units in the copolyester chain of the higher-shrinkage filaments. Illustrative of structural units which may be used as crystallization retardants in the polyester chain are

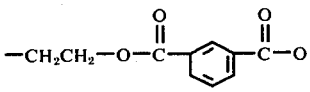

from ethylene glycol and isophthalic acid,

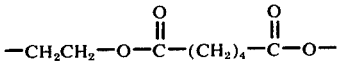

from ethylene glycol and adipic acid,

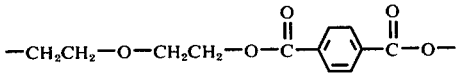

from diethylene glycol and terephthalic acid,

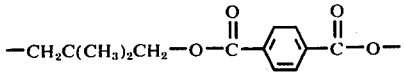

from 2,2-dimethyl-1,3-propanediol and terephthalic acid,

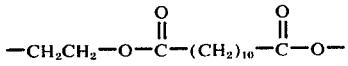

from ethylene glycol and dodecanedioic acid,

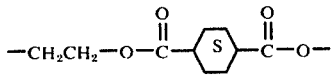

from ethylene glycol and hexahydroterephthalic acid, and others of the same class represented by the general formula

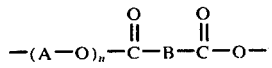

wherein A is a lower alkylene group containing at least 2 carbon atoms; $n$ is 1, 2 or 3; and B is a divalent hydrocarbon group having up to 10 carbon atoms in the polyester chain and is free from aliphatic unsaturation. Preferably, the yarns according to this invention contain about 50 percent of lower-shrinkage filaments and about 50 percent of higher-shrinkage filaments and the denier per filament is substantially uniform and between about 1 and 5. Yarn deniers are preferably at the commercial levels. Filaments with round or other cross-sections may be used for either or both components.

The mixed-shrinkage yarn of the present invention is characterized by lower-shrinkage and higher-shrinkage filaments having a degree of filament intermingling between 65 and 100 percent (preferably about 80 to 100 percent) when measured as described in U.S. Pat. No. 3,593,513.

It was found that to produce the aesthetically pleasing bulky fabrics of this invention, the yarns must have a DFL of at least 3.5%. If their DFL is lower than this value, the fabrics lack bulk.

The difference in CI between the lower-shrinkage filaments and the higher-shrinkage filaments; i.e., $CI_L$ (lower-shrinkage filaments) minus $CI_H$ (higher-shrinkage filaments) is a linear (straight line) function of $CI_L$ of the lower-shrinkage filaments when the DFL of the yarn containing the two groups of filaments is 3.5%. The drawing illustrates this relationship. Two lines are shown. Line I is for mixed-shrinkage yarns containing polyethylene terephthalate homopolymer lower-shrinkage filaments and Line II is for mixed-shrinkage yarns containing 2G-T/IS(98/2) lower-shrinkage filaments. The ordinate is $\Delta CI$; that is, $CI_L$ of the lower-shrinkage filaments minus $CI_H$ of the higher-shrinkage filaments, and the abscissa is the $CI_L$ of the corresponding lower-shrinkage filaments. The mathematical formulas for the lines are:

LINE I: $\Delta CI = 0.39$ ($CI_L$ of lower-shrinkage filaments) — 26.1

LINE II: $\Delta CI = 0.13$ ($CI_L$ of lower-shrinkage filaments) — 3.5

The illustrated lines (I and II) thus represent minimum values for $\Delta CI$ and are a covenient guide in practicing this invention. Yarns containing filaments with values of $\Delta CI$ which fall below the line are not consistent with this invention. On the other hand, yarns containing filaments with values of $\Delta CI$ on or above the line are consistent with the practice of this invention and pleasing bulky fabrics can be made with them provided that they also conform to other standards taught herein.

Without going into unnecessary details on the derivation of the lines shown in the drawing, the conception proceeded from a discovery, unknown before, that the $CI_L$ of polyethylene terephthalate homopolymer, its sulfonate-modified copolymers (as herein defined) and other higher-shrinkage copolymers (as herein defined) are single-valued mathematical functions of their respective shrinkages (CS for the higher-shrinkage filaments and DHS for the lower-shrinkage filaments). By setting a minimum value of 3.5% on DFL (the lowest tolerable DFL to produce the improved fabrics of this invention) and knowing the shrinkage of either the higher- or the lower-shrinkage filaments and its corresponding CI value (from the above relationship), and using the relationship shown above for DFL, the minimum CS of the higher-shrinkage (or the maximum DHS shrinkage of the lower-shrinkage filaments, whichever the case may be) is found and the CI is then obtained from the above relationship. The $\Delta CI$ which is a minimum value for the particular polymer system then forms one point on one of the lines of the drawing (homopolymer or sulfonate-modified copolymer filaments as the case may be).

$CI_L$ of the lower-shrinkage filaments should not exceed about 80 percent or processing problems such as filament fusion will occur in processing. Also, $CI_L$ of the lower-shrinkage filaments should be above 35 percent for polyethylene terephthalate homopolymer and above about 50 percent for sulfonate-modified copolymer to ensure that the shrinkage of the higher-shrinkage filaments to be produced therewith is not too high for acceptable trade standards, and to make sure that the DFL of the yarn is not too low.

It was totally unexpected that 2G-T or sulfonate-modified copolymer thereof could be spun and drawn at the same temperatures and draw ratios to produce the same or nearly the same break elongations as a different ethylene terephthalate copolymer and yet to produce a mixed-shrinkage yarn that is highly bulkable and has other aesthetic qualities sought after in commerce.

It is important that the relative viscosity of each group of filaments of the new yarns be within certain ranges. If the RV of the high-shrinkage filamentary component of the new yarns is greater than about 40, it will be difficult to select a suitable common draw ratio. If the RV of the high-shrinkage filamentary component is less than about 28, its draw ratio will be too high and the DFL will be below the lower limit specified for a satisfactory product.

The yarns of the present invention are, in general, produced by conventional melt-spinning techniques. Preferably, they are produced by cospinning both polymeric species through a single spinneret, one species extruding through some of the orifices of the spinneret and the other species through the other orifices. Methods for doing this are known in the art as disclosed, for example, in Reese U.S. Pat. No. 3,593,513. The new yarns may be spun and drawn as an integral yarn and thereafter annealed and wound up onto a suitable package.

The fact that the new yarns may be produced by cospinning and codrawing presents an economic advantage because separate equipment is not required to process each filament species. Also, because the yarns may be cospun and codrawn, the filament species are well intermingled, producing a uniform visual appearance in fabrics made therefrom.

In order to produce the yarns of the present invention, the filaments are annealed under restraint in their manufacture to allow the low-shrinkage filaments to reach a $CI_L$ of above 35% in the case of polyethylene terephthalate filaments and above about 50% for sulfonate-modified copolymer. This is preferably carried out by passing the yarn over draw rolls which are heated to a temperature within the range of about 110° to 175° C and usually about 140° C. The upper temperature for annealing should be lower than the sticking temperature of the higher-shrinkage component and the lower temperature for annealing should be high enough to insure that the CS of the higher-shrinkage component be less than 20 percent, preferably less than 15 percent. When using certain polymers as the high-shrinkage component, such as poly(ethylene terephthalate/dodecanedioate) (90/10), draw roll temperatures as high as 175° C may be used without adversely affecting the differential filament length property.

The invention will be further illustrated by the following examples of embodiments, which are not intended to be limitative. Cospun yarns not exceeding the specified difference in break elongation will have a DFI above 65.

EXAMPLE I

This example shows the importance of controlling the Crystallinity Index (CI) of each filamentary component in the practice of the present invention.

A. ΔCI of the yarn is in accordance with the present invention.

2G-T/IS (98/2) flake as described in Griffing and Remington U.S. Pat. No. 3,018,272 of 16 RV and 2G-T/I (90/10) flake of 40 RV are separately melted and cospun to a 28 filament composite yarn by delivering equal volumes of each polymer melt to a spinneret containing orifices of uniform size (15 mils diameter, 60 mils depth) arranged in concentric rings with an equal number of orifices in each ring. The two polymer melts are prevented from mixing. The 2G-T/IS copolymer is spun through the outer ring and the other copolymer is spun through the inner ring. Spinning temperature, measured at the spinneret, is 300° C. The filaments are airquenched in normal fashion, finish applied, and drawn 4.5X to 70 denier by passing in contact with a draw pin situated between a feed roll and a set of two heated draw rolls. The draw pin is partially immersed in 95° C water. The filaments are wrapped 16 times around the two spaced-apart, canted draw rolls, which are heated to 140° C. The filaments are then given a second coating of a standard finish and are passed to a suitable windup. Windup speed is about 2,700 yards per minute (2,469 meters/minute). Break elongation of each filament group of the composite yarn is about 23 percent. The yarn has a tenacity of 3.5 grams per denier. The 2G-T/IS filaments have a relative viscosity (RV) of 14.9, a density between 1.378 and 1.3980, while the 2G-T/I filaments have an RV of 38, a density of less than 1.3785. The break elongations of the two filament species of the yarn differ by no more than 15 percent. The differential filament length (DFL) is found to be 5.5 percent. ΔCI is in accordance with the present invention. The yarn forms no undesirable loops when removed from the package. Fabric woven from the yarn and finished in normal manner has a worsted-like hand.

B. ΔCI lower than stated limit.

Part A is repeated except that the RV of the 2G-T/IS filaments is greater than 22 and the yarn is annealed at 180° instead of at 140° C. Broken filaments are severe. DFL is only 1.0 percent. ΔCI is 0.5; CS of the higher-shrinkage filaments is about 7 percent; $CI_L$ of the low-shrinkage filaments is 82 percent.

C. RV of the low-shrinkage filamentary component is too low.

Part A of this example is repeated with the exception that the RV of the 2G-T/IS flake is 13 and the RV of the 2G-T/I flake is 40; the draw ratio is 4.8X. The RV of the 2G-T/IS filaments is 13 and the RV of the 2G-T/I filaments is 34. The tenacity of the yarn is 3.2 grams per denier, and the break elongation of both species of filaments is 22 percent. The DFL of this yarn is 6.4 percent. A seven-ounce-per-square-yard (237.4 grams-per-square-meter) 2 × 2 twill herringbone greige fabric is made from this yarn using 58 ends per inch (22.8 ends per centimeter) for the warp and 56 picks per inch (22.0 picks per centimeter) for the filling. After testing the fabric for the effects of abrasion by a standard test, the fabric is found to be unacceptable because it is damaged severely by abrasion. The damage is found to be caused by wear-off of the low-shrinkage filamentary component.

D. RV of the high-shrinkage component is too low.

Part A of this example is repeated with the exception that the high-shrinkage component is poly(ethylene terephthalate/adipate) (92/8), abbreviated "2G-T/6", the RV of the 2G-T/6 flake is 27, and the RV of the 2G-T/IS flake is 16. The RV of the 2G-T/6 filaments is 25, and the RV of the 2G-T/IS filaments is 15. Draw ratio is 4.7; spinneret orifices are round and 15 mils in diameter and 60 mils long. The temperature of the draw rolls has to be reduced to 120° C in order to produce any differential length change whatever in the filaments. The difference in break elongation between components is greater than 15%. This leads to either flashes (undrawn segments) or broken filaments, depending on draw ratio in yarn preparation. The fabric is unacceptable.

EXAMPLE II

This example shows a different mole ratio in the higher-shrinkage component.

Part A of Example I is repeated, using 2G-T/6 (95/5) of 40 RV (flake) as the high-shrinkage component and 2G-T/IS (98/2) of 16 RV (flake) as the low-shrinkage member. Draw ratio is 4.6X instead of 4.5X, and the draw roll temperature is 134° instead of 140° C. The RV of the 2G-T/6 filaments is 33 and the RV of the 2G-T/IS filaments is 16. The DFL of this composite yarn is 7.1 percent, the tenacity is 4.7 grams per denier, and the break elongation is 23 percent. Both components of the yarn have approximately equal break elongations. CI's are in accordance with the invention. The yarn is of high quality. No loops occur when the yarn is withdrawn from the package. When the yarn is woven to a fabric, the fabric has excellent bulk even after heat-setting, and it has a worsted-like hand.

EXAMPLE III

This example shows the production of various lower-shrinkage and higher-shrinkage filaments and shows their suitability in the practice of the invention.

A series of polyesters, having 90 mole percent recurring structural units represented by the formula:

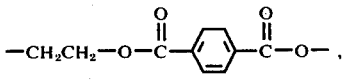

and 10 mole percent of additional structural units represented by a formula shown in Part I of the following table are melt-spun from flake, using a conventional spinneret having 34 round orifices of 15-mil (0.0038 cm) diameter and 30-mil length (0.0076 cm) to produce higher-shrinkage filaments. Conventional air quench is used to quench the filaments as they extrude from the spinneret.

The yarns are steam-drawn, using a conventional steam draw-jet at 160° C and 50 p.s.i.g. situated between feed and draw rollers. The draw rolls rotate at a peripheral speed of about 2,550 yards per minute (2,332 meters/min.), are heated to the annealing temperature shown in order to obtain the CS shrinkages shown; yarns wrap around them as in the previous examples. The draw ratios and deniers after drawing are indicated in Part I of the Table.

The example is repeated with the exception that the polymers contain 98 mole percent of recurring structural units represented by the formula:

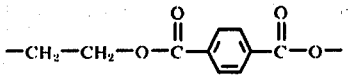

and 2 mole percent (except for Item F, which has 1.6 mole percent) of additional structural units represented by a formula shown in Part II of the Table.

The yarn products of this invention are obtained by selecting a high-shrinkage component and a low-shrinkage component listed in the tables of this Example, each of which has been spun, drawn, and annealed under substantially the same conditions. Suitable cospinnable yarns are those in which the ΔCI obtained by subtracting $CI_H$ from $CI_L$ is equal to or greater than ΔCI calculated from the formula $$(0.39-0.13M)CI_L-26.1 + 11.3M$$

The percent DFL which should be obtained can be calculated from the percent CS and percent DHS values provided in sections I and II of the tables. Calculations are performed as shown earlier.

TABLE

| I. Higher-Shrinkage Component: Formula of Additional Structural Units Present In Copolyester | Extrusion Temperature (°C) | Draw Ratio | Annealing Temperature (°C) | Denier | Elongation at Break (%) | Tenacity (g/Den) | RV Of Yarn | Density of Yarn |
|---|---|---|---|---|---|---|---|---|
| 1) 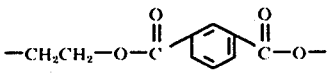 | 295 | 4.1:1 | 175<br>143<br>122 | 70 | 23 | 4.7 | 32 | 1.3832<br>1.3728<br>1.3675 |
| 2) 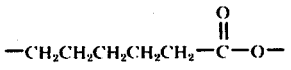 | 297 | 4.1:1 | 175<br>160<br>128 | 68 | 27 | 4.0 | 32 | 1.3650<br>1.3630<br>1.3607 |
| 3) 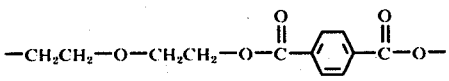 | 290 | 4.0:1 | 175<br>170<br>160 | 70 | 21 | 4.5 | 37 | 1.3790<br>1.3770<br>1.3750 |
| 4) 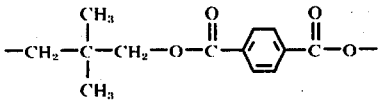 | 290 | 3.8:1 | 175<br>160 | 71 | 24 | 3.4 | 30 | 1.3450<br>1.3415 |
| 5) $-CH_2CH_2-O-C-(CH_2)_{10}-C-O$ | 290 | 4.3:1 | 175<br>160<br>150 | 73 | 22 | 4.5 | 37 | 1.3534<br>1.3516<br>1.3475 |
| 6) $-CH_2CH_2-O-C-(CH_2)_4-C-O-$ | 290 | 4.0:1 | 175<br>132<br>103 | 72 | 17 | 5.4 | 40 | 1.3799<br>1.3666<br>1.3622 |
| 7) 50:50 mixture of (1) and (2) | 290 | 4.0:1 | 175<br>153<br>130 | 70 | 25 | 4.7 | 35 | 1.3820<br>1.3735<br>1.3668 |

| | ρa | ρc-ρa | $CI_H$ (%) | CS(%) |
|---|---|---|---|---|
| | | | 74 | 9 |
| 1) | 1.3386 | 0.0606 | 56 | 15 |
| | | | 48 | 20 |
| 2) | 1.3281 | 0.0586 | 63 | 12 |
| | | | 59 | 15 |
| | | | 52 | 20 |
| 3) | 1.3363 | 0.0845 | 51 | 15 |
| | | | 48 | 17 |
| | | | 46 | 20 |
| 4) | 1.3114 | 0.0611 | 55 | 15 |
| | | | 49 | 20 |
| 5) | 1.3225 | 0.0517 | 60 | 14 |
| | | | 56 | 15 |
| | | | 48 | 20 |
| 6) | 1.3357 | 0.0588 | 75 | 8.2 |
| | | | 53 | 15 |
| | | | 45 | 20 |
| 7) | 1.3354 | 0.0650 | 72 | 10 |
| | | | 58 | 15 |
| | | | 51 | 20 |

| II. Lower-Shrinkage Component: Formula of Additional Structural Units In Copolyester | Extrusion Temperature (°C) | Draw Ratio | Annealing Temperature (°C) | Denier | Elongation at Break (%) | Tenacity (g/Den) | RV of Yarn | Density of Yarn |
|---|---|---|---|---|---|---|---|---|
| A. Formula a | 295 | 4.1:1 | 175<br>170<br>160<br>140<br>120<br>100 | 70 | 25 | 3.7 | 15.5 | 1.3980<br>1.3970<br>1.3920<br>1.3890<br>1.3838<br>1.3812 |
| B. Formula c | 295 | 4.0:1 | 175<br>160 | 70 | 26 | 3.2 | 15.5 | 1.3888<br>1.3857 |

TABLE-continued

| | | | | | | | | | |
|---|---|---|---|---|---|---|---|---|---|
| | | | | 140 | | | | | 1.3810 |
| | | | | 120 | | | | | 1.3740 |
| | | | | 110 | | | | | 1.3630 |
| C. (Homopolymer) | | | 277 | 4.0:1 | 175 | 70 | 30 | 3.3 | 15.5 | 1.4008 |
| | | | | | 160 | | | | | 1.4000 |
| | | | | | 140 | | | | | 1.3940 |
| | | | | | 120 | | | | | 1.3850 |
| | | | | | 100 | | | | | 1.3820 |
| D. Formula b | | | 295 | 4.0:1 | 175 | 70 | 20 | 3.2 | 18 | 1.4004* |
| | | | | | 160 | | | | | 1.3980* |
| | | | | | 140 | | | | | 1.3879* |
| | | | | | 120 | | | | | 1.3850* |

| | ρa | ρc-ρa | $CI_t$ (%) | DHS (%) |
|---|---|---|---|---|
| A. | 1.3446 | 0.0667 | 80 | 7.0 |
| | | | 79 | 6.8 |
| | | | 71 | 8.0 |
| | | | 66 | 9.0 |
| | | | 59 | 12.0 |
| | | | 55 | 14.0 |
| B. | 1.3419 | 0.0600 | 78 | 6.4 |
| | | | 72 | 7.7 |
| | | | 65 | 10 |
| | | | 58 | 12 |
| | | | 35 | 17 |
| C. | 1.3400 | 0.0759 | 90 | 4 |
| | | | 79 | 6 |
| | | | 71 | 7 |
| | | | 59 | 9 |
| | | | 49 | 11 |
| D. | 1.3418 | 0.0745 | 79 | 6.1 |
| | | | 75 | 7.5 |
| | | | 62 | 9.7 |
| | | | 58 | 12.2 |

*This polymer required longer-than-usual time to reach steady-state conditions in the density-gradient tube.

EXAMPLE IV

This example shows the preparation of another yarn of the present invention.

2G-T/IS (98/2) flake as described in Griffing and Remington U.S. Pat. No. 3,018,272 and 2G-T/6 (87.5.5/12.5) are separately melted and cospun to a 34 filament composite yarn by extruding equal volumes of each polymer melt to a spinneret containing orifices of 9 mil diameter and 12 mil depth. The orifices of the spinneret are arranged in six parallel rows; the three rows on one side of the centerline extrude one species; the three on the other side extrude the same number of filaments of the other species. Spinning temperature, measured at the spinneret is 290° C. The filaments are air-quenched in normal fashion, finish applied and drawn 4.4X to 130 denier yarn using room-temperature draw rolls, followed by a second set of rolls running at the same speed and heated to 130° C. As in Example III, a steam jet (220° C, 70–90 p.s.i.g.) is situated between the feed and draw rollers. Draw roller peripheral speed is 2700 yds./min. The filaments are coated with a standard finish and are wound up at conventional package tensions. Important properties are:

| | Break Elongation (%) | Tenacity gm/den | Filament RV | CI | CS (%) | DHS (%) |
|---|---|---|---|---|---|---|
| Higher-shrinkage Species | 29 | 4.4 | 34 | 60 | 17 | — |
| Lower-shrinkage Species | 27 | 3.4 | 16 | 65 | — | 11.4 |

DFL is about 4.6 percent and DFI is about 90 percent. This is a very high-quality bulkable yarn. Fabrics woven from it possess a high degree of bulk and are exceedingly attractive.

EXAMPLE V

This example shows the preparation of a preferred yarn of the invention; the higher shrinkage filaments are poly(ethylene terephthalate/glutarate), abbreviated 2G-T/5.

2G-T/IS (98/2) flake as described in Griffing and Remington U.S. Pat. No. 3,018,272 and 2G-T/5 (85.6/14.4) are separately melted and cospun to a 26 filament composite yarn by extruding equal volumes of each polymer melt through a spinneret containing six rows of orifices. Three rows of orifices produce trilobal cross-section, as shown in Holland U.S. Pat. No. 2,939,201 ("modification ratio" is about 2.1), 2G-T/5 filaments; the other three produce round cross-section 2G-T/IS filaments; the round orifices are of the same size as in Example IV. The spinning temperature at the spinneret is 295° C. The filaments are air quenched in normal fashion, finish applied, and drawn 3.3X to 70 denier using roomtemperature draw rolls running at a peripheral speed of 3500 yds/min. As in Example III, a steam jet, supplied with 220° C, 80 psig steam, is situated between the feed and draw rolls. The yarn is fed from the draw rolls to a second set of rolls running at the same speed and heated to 130° C. The filaments are interlaced by an air jet as described in Bunting et al U.S. Pat. No. 2,985,995, finish is applied and are wound up at conventional package tensions. The important properties are:

| | Break Elongation (%) | Tenacity gm/den | Filament RV | ρa | ρc | Filament Density (ρx) | CI(%) | CS(%) | DHS(%) |
|---|---|---|---|---|---|---|---|---|---|
| Higher Shrinkage Species | 28 | 3.5–4.0 | 32 | 1.3405 | 1.4149 | 1.3815 | 55 | 14.2 | — |
| Lower Shrinkage Species | 28–43 | 3.5–4.0 | 15 | 1.3446 | 1.4113 | 1.3856 | 61 | — | 8.2 |

$\Delta CI = 6$; $(0.39-0.13M)CI_L - 26.1 + 11.3M = 4.4$; DFL is 7.1 and DFI is 90%. The yarn is a high quality bulky yarn.

EXAMPLE VI

This example shows the preparation of a preferred yarn of this invention; the higher-shrinkage filaments are poly(ethylene/2,2-dimethyl-1,3-propylene terephthalate), abbreviated 2G-T/DM3G-T.

2G-T/IS (98.2) flake as described in Griffing and Remington U.S. Pat. No. 3,018,272 and 2G-T/DM3G-T (90/10) are separately melted and cospun to a 26 filament composite yarn by extruding equal volumes of each polymer melt through a spinneret containing six rows of orifices.

Three rows of orifices produce trilobal cross-section 2G-T/DM3G-T filaments as shown in Holland U.S. Pat. No. 2,939,201 ("modification ratio" is about 2.1); the other three produce round cross-section 2G-T/IS filaments; the round orifices are of the same size as in Example IV. The spinning temperature at the spinneret is 295° C. The filaments are air quenched in normal fashion, finish applied and drawn 3.4X to 70 denier using room-temperature draw rolls running at a peripheral speed of 3500 yds/min. As in Example III, a steam jet, supplied with 220° C, 80 psig steam, is situated between the feed and draw rolls. The yarn is fed from the draw rolls to a second set of rolls running at the same speed and heated to 140° C. The filaments are interlaced by an air jet as shown in Bunting et al, U.S. Pat. No. 2,985,995, finish is applied and are wound up at conventional package tensions. The important properties are:

| | Break Elongation (%) | Tenacity gm/den | Filament RV | ρa | ρc | Filament Density (ρx) | CI(%) | CS(%) | DHS(%) |
|---|---|---|---|---|---|---|---|---|---|
| Higher-Shrinkage Species | 26 | 3.5–4.0 | 28 | 1.3271 | 1.4083 | 1.3794 | 64 | 13.4 | — |
| Lower Shrinkage Species | 28–40 | 3.5–4.0 | 15 | 1.3977 | 1.4113 | 1.4030 | 80 | — | 9.2 |

$\Delta CI = 16$; $(0.39-0.13M)\ CI_L - 26.1 + 11.3M = 6.9$; DFL is 7.0% and DFI is 95%. The yarn is a high quality bulky yarn.

The mixed-shrinkage yarn of the present invention provides excellent bulk and worsted-like aesthetics in an all-polyester yarn. Fabrics prepared from yarns of the present invention have unusual bulk and texture and possess the aesthetics of worsted fabrics. These qualities coupled with the inherent advantages of all-polyester fabrics, including moth and mildew resistance, make such fabrics highly desirable in today's market.

Fabrics produced from the new yarns may be made into slacks, coats, jackets, dresses, suits, and the like. Interesting dyeing effects can be obtained with fabrics made from the yarn of the present invention which comprises a mixture of 2G-T/IS fiber with another copolymer fiber such as 2G-T/I. The 2G-T/I fiber dyes easily with disperse dyes, but it does not take up cationic dyes; whereas the 2G-T/IS fiber takes up both disperse and cationic dyes.

I claim:

1. A mixed-shrinkage polyester yarn composed of 25 to 75 percent low-shrinkage filaments and 75 to 25 percent higher-shrinkage filaments having a degree of filament intermingling between 65 and 100 percent; the low-shrinking filaments consisting of a polymer of about 97 to 100 mole percent ethylene terephthalate structural units and about 3 to 0 mole percent of polymer structural units which contain sulfonate groups as pendant parts of repeating units in the polymer chain, having a crystallinity index ($CL_L$) of about 35 to about 80 percent and a relative viscosity of about 14 to 19; the higher-shrinkage filaments consisting of a polymer of about 85 to 95 mole percent ethylene terephthalate structural units and 15 to 5 mole percent of other ester units forming a copolyester therewith, having a relative viscosity of 28 to 40 and a crystallinity index ($CI_H$) such that $CI_L$ minus $CI_H$ is equal to or greater than the value obtained by the formula $(0.39-0.13M)\ CI_L - 26.1 + 11.3M$ wherein M is the mole percent of said sulfonate-containing polymer structural units in the low-shrinking filaments; the filaments of the yarn being free from undrawn segments and having break elongations within a range of 15 percent units.

2. A mixed-shrinkage yarn as defined in claim 1 wherein said degree of filament intermingling is about 80 to 100 percent.

3. A mixed-shrinkage yarn as defined in claim 1 wherein the higher-shrinkage filaments consist of a copolyester having 85 to 95 mole percent ethylene terephthalate structural units and 15 to 5 mole percent other structural units represented by the formula:

$$-(A-O)_n-\overset{O}{\overset{\|}{C}}-B-\overset{O}{\overset{\|}{C}}-O-$$

wherein A is a lower alkylene group containing at least 2 carbon atoms; $n$ is 1, 2 or 3; and B is a divalent hydrocarbon group having up to 10 carbon atoms in the polyester chain and is free from aliphatic unsaturation.

4. A mixed-shrinkage yarn as defined in claim 1 wherein the break elongations of the filaments are between 18 and 40 percent.

5. A mixed-shrinkage yarn as defined in claim 1 wherein the denier per filament if substantially uniform and between 1 and 5.

6. A mixed-shrinkage polyester yarn composed of 25 to 75 percent low-shrinkage filaments and 75 to 25 percent higher-shrinkage filaments having a degree of filament intermingling between 80 and 100 percent; the low-shrinking filaments consisting of a polymer of 95 to 100 mole percent ethylene terephthalate structural units and 5 to 0 mole percent ethylene 5-(alkali metal sulfo)isophthalate structural units, having a relative viscosity of about 14 to 19 and a density of at least 1.3800; and the higher-shrinkage filaments consisting of a different polyester of 85 to 95 mole percent ethylene terephthalate structural units and 15 to 5 mole percent of other ester units to retard crystallization, having a relative viscosity of about 28 to 40, a density of less than 1.3840, a boil-off shrinkage greater than 7.5 percent and a break elongation within 15 percentage units of the low-shrinkage filaments.

* * * * *